US006099175A

United States Patent [19]

Maurer et al.

[11] Patent Number: 6,099,175

[45] Date of Patent: Aug. 8, 2000

[54] METHOD AND APPARATUS FOR PRINTING TEXT ON A BOOKLET-LIKE ARTICLE

[75] Inventors: Thomas Maurer, Munich; Walter Renz, Seefeld-Drössling; Peter Schweiger, Munich, all of Germany

[73] Assignee: Maurer Electronics GmbH, Munich, Germany

[21] Appl. No.: 09/300,403

[22] Filed: Apr. 27, 1999

[30] Foreign Application Priority Data

May 5, 1998 [EP] European Pat. Off. ..... 98 108 180

[51] Int. Cl.[7] ..... B41J 11/06

[52] U.S. Cl. ..... 400/24; 400/48

[58] Field of Search ..... 400/48, 76, 24, 400/25; 101/474, 485

[56] References Cited

U.S. PATENT DOCUMENTS

| | | | |
|---|---|---|---|
| 4,143,977 | 3/1979 | Kurihara et al. | 400/24 |
| 4,743,129 | 5/1988 | Keyhuel et al. . | |
| 4,744,296 | 5/1988 | Edwards et al. | 400/48 |
| 5,040,908 | 8/1991 | Matsuya et al. | 400/24 |
| 5,823,688 | 10/1998 | Mizukami et al. | 400/24 |

FOREIGN PATENT DOCUMENTS

| | | | |
|---|---|---|---|
| 0233735 | 3/1986 | Germany | 400/48 |
| 56-58892A | 5/1981 | Japan | 400/48 |
| 61-154963 | 12/1984 | Japan . | |
| 60-270354 | 11/1987 | Japan | 400/48 |
| 63-218384 | 9/1988 | Japan . | |

OTHER PUBLICATIONS

"Method For Passbook Discrimination on the Banking Printer" IBM Technical Disclosure Bulletin, vol. 32 No. 10B, Mar. 1990 p. 124–125.

*Primary Examiner*—Eugene Eickholt
*Attorney, Agent, or Firm*—Laubscher & Laubscher

[57] ABSTRACT

The invention relates to a process for printing text on a sheet of a booklet-like article in a text-printing station, in the case of which the booklet-like article is arranged in a swung-open state in a cassette (10) and fed to the text-printing station. Then the position in the text-printing station of the border of the sheet which is to have text printed on it is detected, as is the position of a pattern provided on the sheet which is to have text printed on it. Thereafter, the sheet has text printed on it such that some of the text is aligned with respect to the pattern and other parts are aligned with respect to the sheet border. The process according to the invention can be carried out particularly advantageously using a cassette which has a base plate (11), with a bearing region (15) and a first bearing surface (17), and also has a frame (12), which is arranged on the base plate such that it can be released at least in part opposite the bearing region (15). The first bearing surface (17) is assigned a second bearing surface, which is offset parallel to the first bearing surface (17) in the direction of the normals of the two bearing surfaces.

21 Claims, 3 Drawing Sheets

METHOD AND APPARATUS FOR PRINTING TEXT ON A BOOKLET-LIKE ARTICLE

BACKGROUND OF THE INVENTION

1. Field of the Invention

The invention relates to a process for printing text on a sheet of a booklet-like article in a text-printing station and to a cassette, in particular a cassette for receiving and handling a booklet-like article made of sheet-like material, as is used, for example, for identity documents, in particular passports.

2. Brief Description of the Prior Art

In the production of identity cards, for example credit cards, bank cards, debit cards, company cards, driving licences and the like, it is known for the individual cards to be removed automatically from a feed store, to be fed to a text-printing station, for example a laser-printing station, and to be aligned, and have text printed on them, therein. Following the text-printing operation, the cards are then deposited in a receiving magazine. Such an automated text-printing apparatus can be used to produce large numbers of identity cards in a short period of time with low outlay in terms of operators.

In contrast, it is more difficult to print text on booklet-like identity documents as are often required in the form of passports. Such booklet-like identity documents, which, for the sake of simplicity, will be referred to just as passports hereinbelow, usually comprise a front and rear cover sheet, a booklet section, which is bound in therebetween and is intended for entries, as well as a sheet for receiving passport data and personal details. This sheet, which may consist, in particular, of a material suitable for laser printing, may be either a special sheet arranged beside one of the cover sheets or the cover sheet itself, which then has to have text printed on its inside.

In order to provide a passport, for example in a laser-printing station, with the passport holder's photograph, his/her personal details and a machine-readable passport identification, it is necessary for the passport to be arranged in a swung-open state in the text-printing station, such that a machine-readable passport identification can be printed in in a manner aligned precisely with respect to one side edge of the sheet which is to have text printed on it, while the personal details and the passport photograph have to be aligned with respect to a pre-printed section.

With an appropriate configuration of the text-printing station, a passport which is to have text printed on it may be positioned by hand, but this involves comparatively high outlay and requires particular care on the part of the operator since satisfactory alignment of the passport or of the sheet in the text-printing station is necessary.

Fully automatic handling of a passport in a text-printing apparatus, in the case of which the passport first of all is swung open, and then introduced into the text-printing station in swung-open state, has text printed on it in the text-printing station, and is then transported further to a removal station, is indeed conceivable, but would necessitate very high outlay in terms of automation, which is associated with considerable costs.

In contrast, the object of the invention is to provide a process by means of which booklet-like articles which are made of sheet-like material and are to have text printed on one of their insides, such as, in particular, passports and other booklet-like identity documents, can easily have text printed on them automatically. In addition, the invention also has the object of providing a cassette which can be used, in particular, for the text-printing process.

These objects are achieved by the process according to claim 1 and by the cassette according to claim 6.

As far as the process is concerned, it is thus provided, for the purpose of printing text on a booklet-like article in a text-printing station, that the booklet-like article is arranged in a swung-open state in a cassette and fed to the text-printing station, that the position in the text-printing station of the border of the sheet which is to have text printed on it is detected, as is the position of a pattern provided on the sheet which is to have text printed on it, and that the sheet has text printed on it such that some of the text is aligned with respect to the pattern and other parts of the text are aligned with respect to the sheet border.

The detection both of the position of the sheet and of the position of a pattern located thereon makes it possible, for example in the case of passports, for a machine-readable passport identification to be aligned precisely parallel to the edge of the sheet, while personal details and a photograph of the passport holder are aligned relative to the pre-printed section which explains this data. The passport identification can thus be read satisfactorily by an appropriate reader unit if the sheet is drawn through said reader unit on the edge parallel to the passport identification, while the rest of the textural and (photo-)graphic elements give an aesthetically pleasing overall impression.

The process according to the invention allows text to be printed automatically without the sheet which is to have text printed on it having to assume a fixedly predetermined position in the text-printing plane. This considerably simplifies the transportation of the passports, arranged in cassettes, from a feed magazine or the like to the text-printing station and, further, to a removal station.

The process may be configured in a particularly straightforward manner if that sheet of the booklet-like article which is to have text printed on it is arranged in the cassette such that the position of the sheet border itself can be detected. For clear detection of the sheet position, it is provided in this case that the position of the sheet border is detected at three points, the position of one edge of the sheet border being detected at two points and the position of a further edge, which is located transversely with respect to the first-mentioned edge, being detected at one point.

Another possibility of establishing the position of the sheet or the sheet border consists in that that sheet of the booklet-like article which is to have text printed on it is guided, in the cassette, by stop and retaining means into a position which is predetermined relative to the cassette, and that the position of the cassette is detected in order to determine the position of the sheet border therefrom. Although it is necessary in this case for the sheet which is to have text printed on it to be arranged in the cassette in a precisely aligned manner, this nevertheless makes it possible to simplify the position-detecting operation of the cassette. With suitable guidance of the cassette in the text-printing station, the task of detecting the sheet position could be reduced here to establishing the position of a single point of the cassette.

A particularly preferred configuration of the invention provides that some of the text is aligned both with respect to the predetermined pattern and with respect to the sheet border. This procedure means that text which is to be printed, or photographs which are to be applied, in particular in the border region of the sheet which is to have text printed on it can be oriented such that they are aligned correctly both with respect to a predetermined pattern on the sheet and with respect to the sheet border.

It is particularly advantageous if the process according to the invention uses a cassette having a base plate, which has a bearing region with a first bearing surface, and a frame, which is arranged on the base plate such that it can be released at least in part opposite the bearing region, it being the case that the first bearing surface is assigned a second bearing surface, which is offset parallel to the first bearing surface in the direction of the normals of the two bearing surfaces.

In order for the handling of the cassette according to the invention to be as straightforward as possible for the introduction of passports and the like, a preferred embodiment of the invention provides that the frame has a frame plate which is fitted on the base plate and on which a swing-action frame member or cover with a window is articulated in a pivotable manner. It is particularly preferred here if, in its closed position, in which it bears on the base plate, the swing-action frame member or cover is arranged over the second bearing surface, which is located closer to the frame, and if the window is subdivided by holding-down webs in order to retain in a planar manner a sheet of a sheet-like article, bearing on the bearing region, which is to have text printed on it.

According to the invention, the swing-action frame member or cover and the second bearing surface thus interact such that a sheet which is arranged on the second bearing surface and is to have text printed on it is forced, by the swing-action frame and in particular by the holding-down webs arranged thereon, into a defined plane, counter to stressing produced when the booklet-like article is swung open, such that the sheet which is to have text printed on it can readily be arranged in the text-printing plane of the text-printing station.

The operation of opening and closing the cassette and of swinging the swing-action cover open and shut are particularly straightforward if the swing-action frame member or cover is retained in its closed position in a releasable manner with the aid of snap-action connecting means.

In order that a passport, which usually consists of a relatively stiff material, does not have to be swung open too far by hand in order to be introduced into the cassette, the invention provides that, in its swung-open position, the swing-action frame encloses an angle of approximately 110° to 150°, preferably of 120° to 140°, in particular 130°, with the base plate. This makes it possible for the passport to be introduced into the cassette merely in a partially opened state and for the passport to be swung open fully as the swing-action frame is swung shut. It has been found here that passports and other booklet-like articles, surprisingly, can be swung open with greater care with the aid of the cassette according to the invention than by hand.

A development of the invention provides that a step with bevelled flank is provided between the first and the second bearing surfaces, the angle $\alpha$ between the flank and the bearing surface which is located closer to the frame being between 205° and 225°, preferably between 210° and 220°, in particular approximately 215°. In order for the passports to be treated with as much care as possible, it is provided that the flank merges smoothly, preferably in a rounded manner, into the bearing surface which is located closer to the frame.

This achieves the situation where, even with the passport swung open to the full extent, the binding need only be swung open partially, while the cover sheet, and if appropriate the associated sheet which is to have text printed on it, need only be bent round out of its plane, by a relatively small angle, in the region beside the binding. This division of the bending action during the swinging-open operation allows careful treatment, in particular, of the binding without other parts of the passport being subjected to loading unnecessarily.

In order to ensure that a passport which is to have text printed on it is aligned precisely in the cassette according to the invention, a development of the invention provides that, on that side of the swing-action cover which is directed towards the base plate, said swing-action cover is provided, in the region of its edge which is remote from its pivot axis, with stop and retaining means in order that a sheet-like article which is to be arranged on the associated bearing surface of the bearing region can be aligned relative to the frame and/or to the base plate.

It is particularly advantageous here if the stop and retaining means are of pocket-like design, with the result that a sheet-like article introduced into the pocket is retained on the swing-action cover, and guided by the latter, as said cover pivots.

The pocket-like stop means further simplify the operation of fitting the individual cassettes according to the invention with passports or the like and, at the same time, increase the alignment accuracy of the passport in the cassette since one part of the passport need only be pushed into the appropriate receiving pocket between the bearing surface and frame plate, while the free corners of the other part, that is to say the free corners of the cover sheet, and if appropriate of the sheet which is to have text printed on it, need to be introduced into the pockets on the swing-action frame, said pockets serving as stop means. Thereafter, the swing-action frame may then be pivoted into its closed position, that sheet of the passport which is to have text printed on it being aligned precisely, while the passport itself is swung open with an extreme amount of care.

The bevelled step flank, provided with appropriate rounded sections, between the two bearing regions of the bearing surface ensures that the cover sheets of the passport cannot be buckled during the swinging-open operation and in the swung-open state.

Another preferred configuration of the invention provides that the second bearing surface is arranged in a strip-like manner over the first bearing surface, along one of the sides thereof, with the result that a sheet of a booklet-like article, bearing on the first bearing surface, which is to have text printed on it can be positioned on the second bearing surface by ways of its free edge, a receiving pocket being provided between the first and the second bearing surfaces.

This makes it possible to have a cassette which is of particularly straightforward configuration and by means of which, in particular in the case of booklet-like articles made of relatively stiff materials, the sheet which is to have text printed on it can be arranged reliably in a defined plane. In this case, the pocket-like receiving region may receive those sheets of the booklet-like article which, when the booklet-like article is in the swung-open state, are located beneath the page which is to have text printed on it. This is usually just the front cover sheet. If, however, the first side, rather than the second side, of the second sheet is to have text printed on it, then virtually all the sheets of the booklet-like article are arranged in the pocket-like receiving region, as a result of which this sheet which is to have text printed on it can be aligned in the same way as in the case in which just the cover sheet is located therebeneath.

In order, in the case of this cassette, to make it easier for the passport to be introduced and, in particular, to make it easier for the sheets which are located beneath the sheet which is to have text printed on it to be introduced into the pocket-like bearing region, it is provided that that border of the second bearing surface which projects over the first bearing surface is of convex design in plan view.

In order to simplify the use of the cassette in the case of the process according to the invention, it is provided that in its strip, which is arranged partially over the second bearing surface, the swing-action frame has monitoring windows for the detection of a sheet border, at least one monitoring window being arranged in a corner region of the swing-action frame, with the result that it is possible to detect the positions of two abutting edges of the sheet border, the second bearing surface being of contrasting colour. Since the monitoring windows provided make it possible to detect the position of the sheet at three defined points, there is no need to provide any additional guide and stop means for ensuring, in the cassette, the alignment of the sheet which is to have text printed on it. This considerably facilitates both the handling and the production of the cassette.

In order that the cassette according to the second embodiment of the invention may also advantageously be used with booklet-like articles made of relatively soft material, it is provided that a convexly arched strip can be fastened on the first bearing surface parallel to the strip-like, second bearing surface, at a distance therefrom. The convexly arched strip carefully supports the cover sheet, and the sheet which is to have text printed on it, in the same way as in the case of the first embodiment of the cassette according to the invention, stressing which causes the sheet which is to have text printed on it to be forced against the frame and the holding-down webs, which are provided in the frame window, being produced at the same time.

The cassette according to the invention thus serves for receiving a swung-open passport or the like which, positioned on the bearing region, is fixed by the frame such that, in the cassette, it can be handled, together with the cassette, in a text-printing apparatus just like an identity card.

It is thus possible for a multiplicity of passports arranged in cassettes according to the invention to be stacked in an appropriate feed magazine of a text-printing apparatus, in order for these passports to be transported automatically into the text-printing station from the feed magazine and following the text-printing operation, as is the case with identity cards, to be deposited in a receiving magazine. After this, all that is required is for the passports to be removed from the cassettes, and the empty cassettes may then be refilled with passports and used again in the manner described.

Although the cassette according to the invention requires passports to be introduced manually into the cassette, it permits automatic transportation of passports through a text-printing apparatus, in particular through a laser-printing apparatus, in an extremely straightforward manner since the passports arranged in the cassettes may simply be treated as large identity cards.

The invention is explained in detail hereinbelow, by way of example, with reference to the drawing, in which:

FIG. 1 shows a partially sectioned side view of a first configuration of the cassette according to the invention, FIG. 2 shows a plan view of an empty, closed cassette according to FIG. 1, FIG. 3 shows a view of the underside of the free border region of a swing-action frame of the cassette according to FIG. 1 in the direction of the arrow III in FIG. 1, FIG. 4 shows a plan view of the corresponding border region of a base plate of the cassette according to FIG. 1 in the direction of the arrow IV in FIG. 1, FIG. 5 shows a section essentially along line V—V in FIG. 3, FIG. 6 shows a section essentially along line VI—VI in FIG. 4, FIG. 7 shows a sectional illustration corresponding to FIGS. 5 and 6 with the cassette closed, FIG. 8 shows a sectional illustration, corresponding to FIG. 1, of a second configuration of the invention, and FIG. 9 shows a plan view of the closed cassette according to FIG. 8.

Components that correspond to one another are provided with the same designations in the various figures of the drawing.

DETAILED DESCRIPTION

Figure 1:
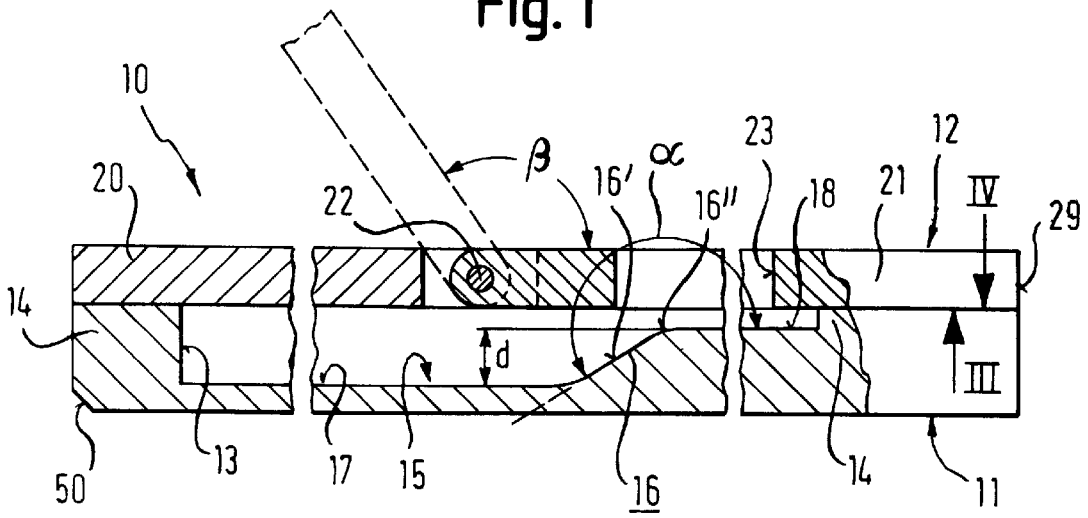

As FIG. 1 shows, a cassette 10 has a base plate 11 and a frame 12 arranged thereon. Provided in the base plate 11 is a recess 13 which is surrounded by webs 14, arranged on the border of the base plate 11, and of which the base forms a bearing region 15 for a swung-open booklet-like article made of sheet-like material, for example a swung-open passport. The bearing region 15 is subdivided by a step 16 into a first and a second bearing surface 17, 18. The two planar bearing surfaces 17, 18 are preferably arranged parallel to one another and are offset with respect to one another by the distance d in the direction of their normals, with the result that one bearing surface 18 is located closer to the frame 12 than the other bearing surface 17. The distance d here is selected in dependence on the thickness of the passport.

For the sake of simplicity, the first bearing surface 17, which in the exemplary embodiment represented is more remote from the frame 12, will be designated hereinbelow, irrespective of the spatial position of the cassette 10, as the bottom bearing surface 17 and the second bearing surface, which is located closer to the frame, will be designated hereinbelow as the top bearing surface 18.

The step 16 between the bottom and top bearing surfaces 17 and 18 respectively, has a bevelled flank 16' which merges into the top bearing surface 18 via a convex rounded section 16". Expediently, it is also possible for the transition region between the flank 16' and the bottom bearing surface 17 to be rounded, it being possible for the radii of curvature of the bottom, concave rounded section and of the top, convex rounded section 16" to be the same, this resulting in a particularly smooth and uniform transition from the bottom bearing surface 17, via the flank 16' of the step 16 and the rounded section 16", to the top bearing surface 18. The bevel of the flank 16' is selected, for example, such that the angle $\alpha$ designed by it and the top bearing region 18 is between 205° and 225°, preferably between 210° and 220°, in particular approximately 215°, if the cassette 10 is provided for a conventional passport. Depending on the thickness of the passports for which the cassette 10 is provided, and on the thickness and flexibility of the sheet-like material of the passports, it is nevertheless possible for the angle a between the bevelled flank 16' and the top bearing region 18, and also for the radius of curvature of the rounded section 16", to be varied in order that, when the passport is swung open and fixed in the swung-open state, the sheet-like material is subjected to the lowest possible degree of loading.

Figure 2:
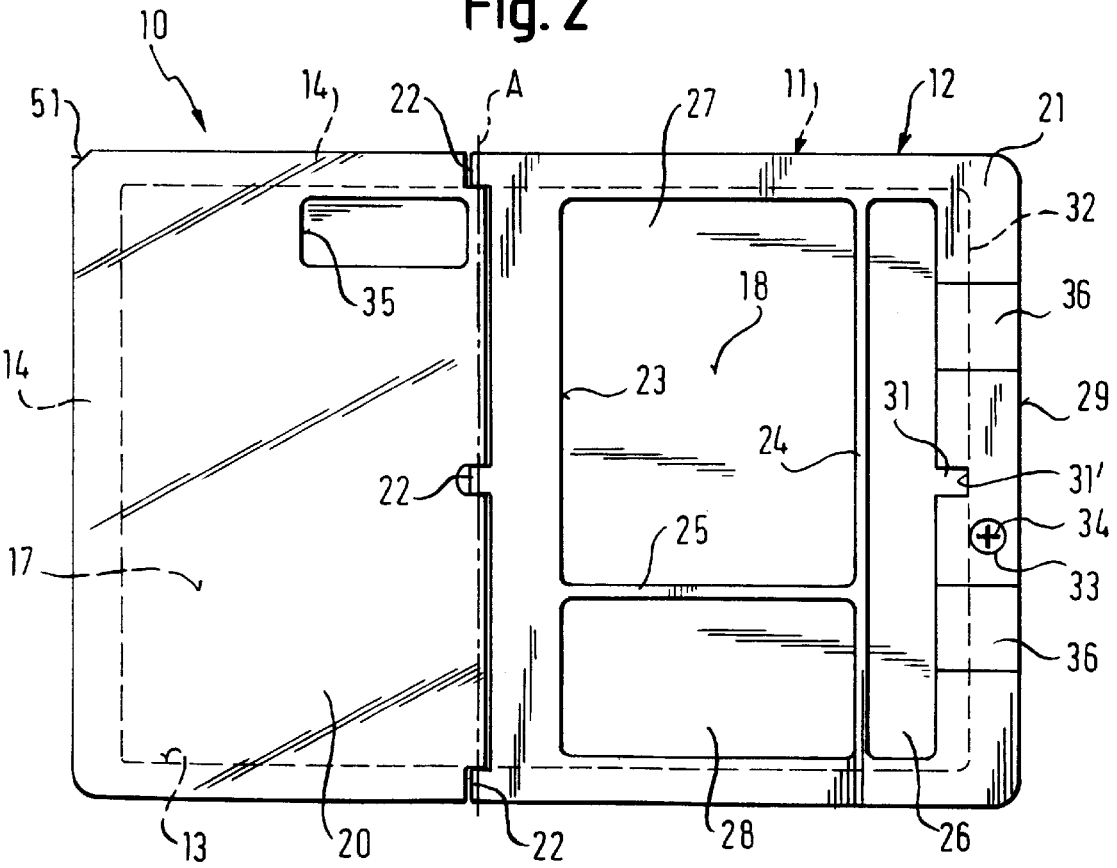

The frame 12, which bears on the webs 14, which surround the bearing region 15 and belong to the base plate 11, comprises a frame plate 20 and a swing-action frame member or cover 21 which, as is illustrated in FIG. 2, is articulated on the frame plate 20 via three articulation connections 22, which define a pivot axis A for the swing-action frame member 21. The articulation connections 22 are designed such that the pivot angle β through which the swing-action frame member 21 travels from its closed position, which is illustrated by solid lines in FIG. 1, into its open position, which is illustrated by dashed lines, is more than 90°, expediently approximately 110° to 150°, preferably 120° to 140° and in particular 130°.

The swing-action frame member 21 of the frame 12 has a window 23 through which text may be printed on a sheet-like article bearing on the top bearing surface 18, for example a passport sheet which is to have text printed on it. In order for the sheet-like material on the top bearing surface 18 to be retained in as planar a position as possible, holding-down webs 24, 25 are provided, and these subdivide the window 23 into individual window sections 26, 27 and 28. The first holding-down web 24 is located parallel to the free edge 29 of the swing-action cover 21 and delimits the window section 26, which extends in a strip-like manner, parallel to the free edge 29, essentially over the entire width of the top bearing surface 18. Provided in a strip 30 of the swing-action frame 21, said strip being assigned to the free edge 29, is a monitoring window 31 which is open towards the window section 26 and of which the edge 31', which is remote from the window section 26, corresponds to the border 32 of the bearing region 15, said border running parallel to the free edge 29. The second holding-down web 25 extends essentially perpendicularly with respect to the pivot axis and subdivides into the window sections 27, 28 the window region which is located to the left of the first holding-down web 24 in FIG. 2. The holding-down webs 24, 25 are thus arranged such that they are assigned to those regions of the sheet material which is to have text printed on it in which no text is to be printed.

Provided in the strip 30 of the swing-action cover 21 is a further monitoring window 33, through which it is possible to detect a mark 34 provided on the web 14 of the base plate 11, said web being assigned to the free edge 29 of the swing-action cover 21.

In order for it to be possible to read, for example, a serial number of a passport arranged in the cassette 10, the frame plate 20 has a further monitoring window 35.

Provided in order that, as a cassette 10 provided with a passport is transported through a text-printing apparatus, the swing-action frame member 21 is retained securely in its closed position are snap-action connections 36, which are only indicated in FIG. 2 and comprise, for example, resilient tongues (not illustrated specifically) with latching noses which are fastened on the swing-action frame member 21 and interact with corresponding latching webs on the base plate 11.

Figure 3:
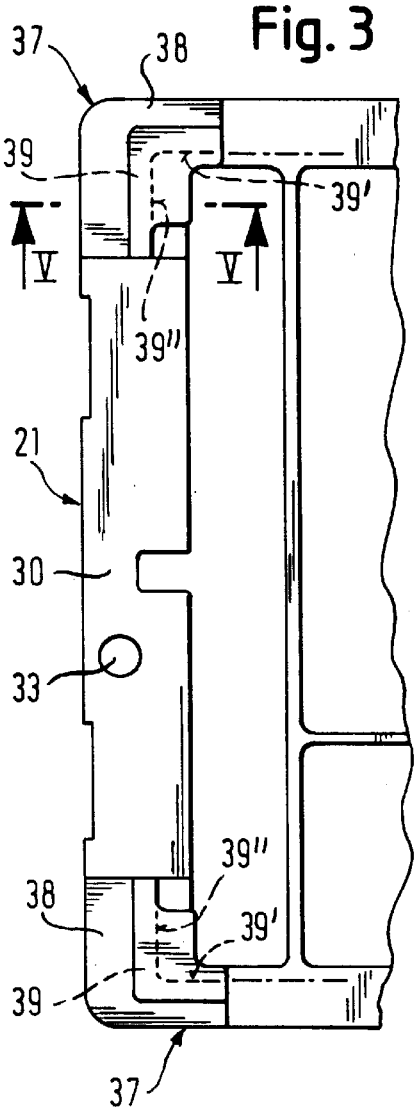
Figure 5:
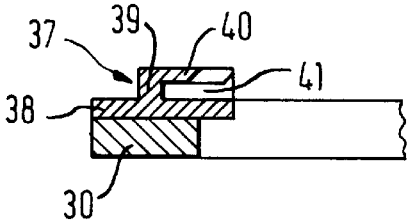

In order to ensure, as a passport is introduced into the cassette 10, that the sheet which is to have text printed on it is aligned in the desired manner in the cassette 10, stop and retaining means 37, which, as is illustrated in FIGS. 3 and 5, are of pocket-like design, are provided for the free corners of the passport sheet which is to have text printed on it. Each of the two stop and retaining means 37 has a fastening plate 38 on which there is formed an L-shaped web 39 which bears an essentially likewise L-shaped retaining plate 40. As can be seen particularly well in FIG. 5, there is formed, between the fastening plate 38, the L-shaped web 39 and the retaining plate 40, a pocket 41 into which a free corner of a sheet which is to have text printed on it can be introduced (in a manner which is not illustrated specifically). This means that the L-shaped web 39 forms, by way of its inner walls 39', 39", a side stop (wall 39') and an end stop (wall 39").

Although the stop and retaining means 37 are illustrated in one piece in the drawing, they may also be made up of a number of individual parts, in order to facilitate production. In particular, it is possible to produce the L-shaped web 39 together with the retaining plate 40 as a part which is, for example, screwed or riveted either directly to the swing-action frame 21 or to the fastening plate 38.

Figure 4:
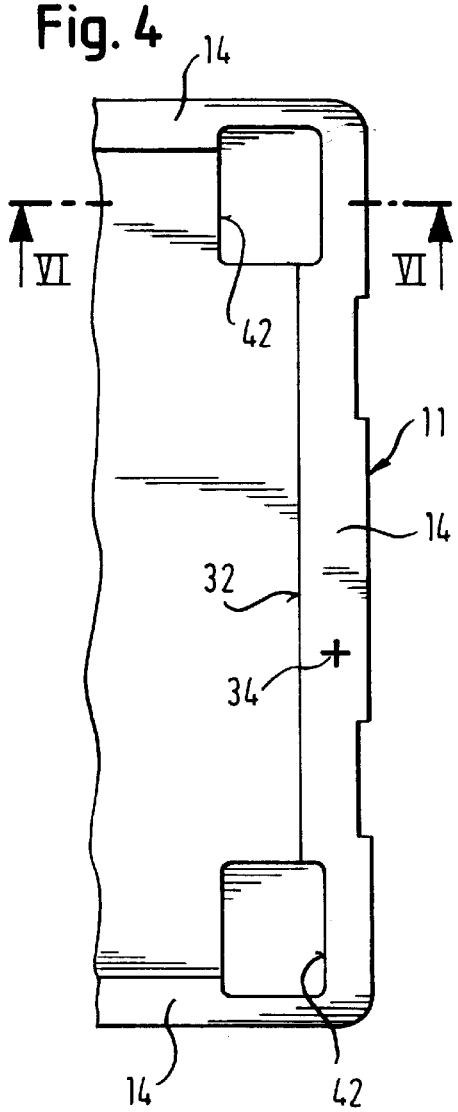
Figure 6:
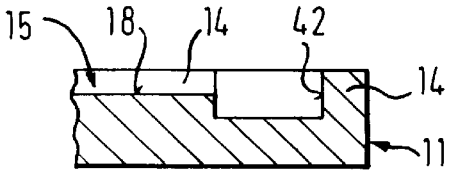
Figure 7:
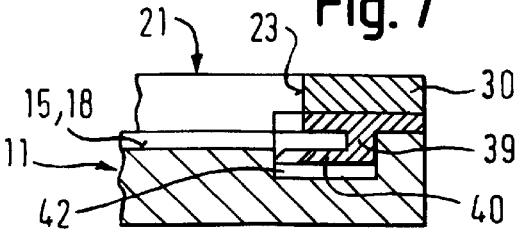

As is shown in FIGS. 4 and 6, recesses 42, which are assigned to the stop and retaining means 37, are provided in the corner regions of the base plate 11, the stop and retaining means 37 passing into said recesses by way of the web 39 and the retaining plate 40 when the swing-action frame 21 is closed, as is shown in FIG. 7. This means that the top bearing surface 18 is in alignment with that inner surface of the retaining plate 40 which delimits the pocket 41.

For the purpose of handling the cassette 10 during automatic transportation through the text-printing apparatus, various cutouts, bevels and chamfers may be provided. FIG. 1 illustrates, for example, a chamfer 50 on the base plate 11, while, in FIG. 2, the left-hand top corner of the cassette 10 has a bevel 51, by means of which correct orientation of the cassette 10 is ensured as said cassette 10 is introduced into a feed magazine.

The operation of introducing a booklet-like article made of sheet-like material into the cassette 10 is explained in more detail hereinbelow using the example of a passport.

First of all, the swing-action frame 21 is pivoted about the pivot axis A into its open position, which is illustrated by dashed lines in FIG. 1. Then a passport (not illustrated specifically) is swung open to the extent where its opening angle is greater than 180°-β, but is preferably smaller than 90°, the sheet which is to have text printed on it lying open. Then the passport is introduced, by way of the booklet section for later entries, into the receiving pocket formed between the frame plate 20 and the bottom bearing surface 17, while that side of the sheet which is to have text printed on it is located opposite the swing-action frame 21. The sheet which is to have text printed on it is introduced, if appropriate together with the associated cover sheet of the passport, by way of its free corners into the pockets 41 of the stop and retaining means 37 in the corner regions of the swing-action cover 21, with the result that the sheet which is to have text printed on it is guided on its free end edge and on its sides by the L-shaped web 39.

As soon as the booklet section of the passport has been fully pushed into that pocket of the cassette 10 which is assigned to the bottom bearing region 17, the binding of the passport bearing on the bottom bearing surface 17 in the region between the pivot axis A and the step 16, the swing-action frame 21 is pivoted into its closed position. In this case, the sheet which is to have text printed on it is positioned smoothly on the top bearing surface 18, the holding-down webs 24, 25 ensuring the smooth and planar positioning.

The positioning according to the invention of the pivot axis A relative to the step 16 achieves the situation where, rather than having to be swung open to the full extent in the region of its binding, the passport need only be swung open in this region to the angle provided between the bevelled flank 16' and the bottom bearing surface 17, this angle being smaller than 180°. In order to achieve the effective swung-open angle of 180°, the sheet which is to have text printed on it is then bent in the vicinity of the binding, via the rounded section 16", by approximately 30° to 40°, preferably by 35°, from its planar position onto the top bearing surface 18. This means that the binding of the passport is treated with care during introduction .into the cassette 10 according the invention, since part of the swinging-open operation takes place by the sheet which is to have text printed on it, and if appropriate the cover sheet associated therewith, being bent round.

When the cassette 10 is closed, the stop and retaining means 37 ensure that the sheet which is to have text printed on it is retained, by way of its free edge butting against the end stops 39", precisely parallel to the strip-like window section 26.

The cassette 10 which is provided with a passport in this way can then be handled automatically in a text-printing apparatus, it being the case that, prior to the text-printing operation in the text-printing station of the text-printing apparatus, the position of the cassette 10 is established with the aid of the adjustment mark 34, and if appropriate further suitable adjustment marks, in order then for the position of the free edge 31' of the passport to be checked through the monitoring window 31 in the web 30 of the swing-action cover 21.

Following introduction of the passport into the cassette 10, the latter is fed preferably automatically from a feed magazine to a text-printing station. As soon as the cassette, with the passport, is located in the text-printing station, the position of the adjustment mark 34 is established in order for the position in the text-printing station of the border of the sheet which is to have text printed on it to be detected. Since, in the case of the cassette described here, the passport is introduced such that the sheet which is to have text printed on it is arranged in a precisely defined manner relative to the cassette, only the position of the cassette in the text-printing station needs to be detected in order for the position of the border of the sheet which is to have text printed on it to be detected. For this purpose, a single adjustment mark 34 is sufficient when the cassette is retained in a constantly defined manner, for example by way of one of its longitudinal sides, on an appropriate stop in the text-printing station. If it is intended to dispense with such forced guidance of the cassette in the text-printing station, then at least a second adjustment mark is necessary in order for the cassette position to be detected.

Thereafter, the position of a pattern provided on the sheet which is to have text printed on it is detected, in this case the pattern being the customary pre-printed section with the notes explaining the personal details.

Then the text is printed, this preferably being carried out dot by dot with the aid of laser light, such that a machine-readable passport identification is aligned with respect to the free edge 31' of the sheet which is to have text printed on it, while the personal details are printed in relative to their explanatory notes. The passport photograph which is usually provided may be aligned either with respect to the personal details and their explanatory notes or with respect to the sheet border. Since the passport photograph is often located in the vicinity of the sheet border, it is often expedient for the passport photograph to be aligned both with respect to the sheet border and with respect to the personal details, in order for the passport page which has text printed on it to give an aesthetically pleasing overall impression. A corresponding compromise is then necessary in this case.

Instead of using the cassette 10 described with reference to FIGS. 1 to 7, it is also possible for the process according to the invention to be carried out using another cassette according to the invention, which is described hereinbelow with reference to FIGS. 8 and 9.

The basic construction of this cassette 10 with base plate 11, frame 12 and bearing region 15 corresponds to that of the abovedescribed cassette 10, so only the differences will be explained here.

Figure 8:
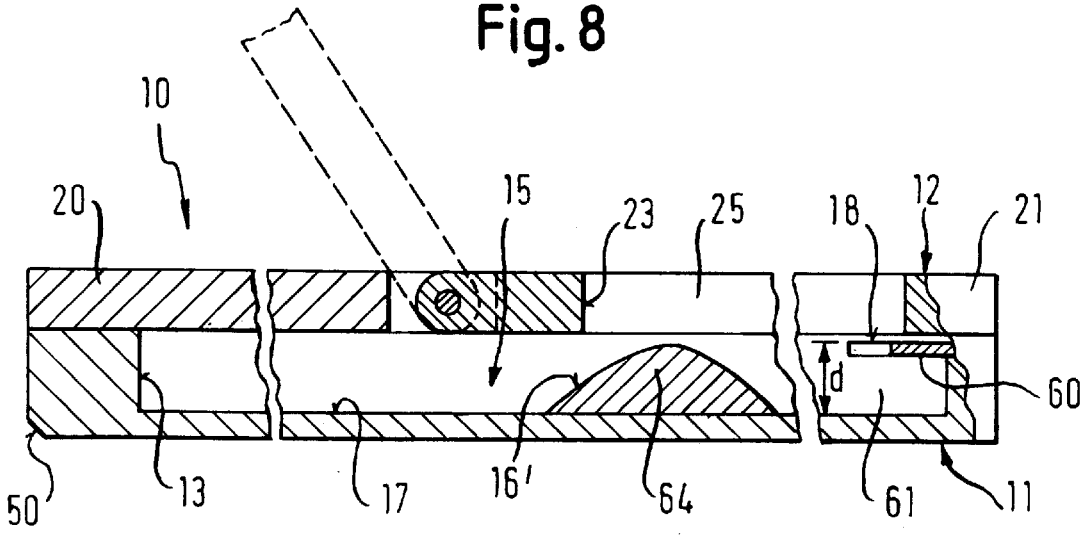

As FIG. 8 shows, the bearing region 15 has a bottom bearing surface 17, which is assigned a top bearing surface 18, which is located at a distance d from the bottom bearing surface 17. In this case, the top bearing surface 18 is formed by the top side of a narrow plate 60 which, as FIG. 9 shows, is located in a strip-like manner parallel to the free edge 29 of the swing-action frame 21 and extends over the bottom bearing surface 17 such that a narrow receiving pocket 61 is formed between the plate 60 and the bottom bearing surface 17.

In order for it to be possible, with the passport introduced into this cassette 10, to detect the position of the sheet which is to have text printed on it, and bears on the top bearing surface 18, monitoring windows 62, 63, which are formed by corresponding cutouts in the swing-action frame 21, are provided. One monitoring window 62 is provided, for example, in the strip 30, in the vicinity of that free edge of the swing-action frame 21 which is at the bottom in FIG. 9, while the other monitoring window 63 is arranged in the top corner of the swing-action frame 21 such that, with the passport introduced, the corresponding corner of the sheet which is to have text printed on it can always be observed, irrespective of the position of the sheet in the cassette 10.

Figure 9:
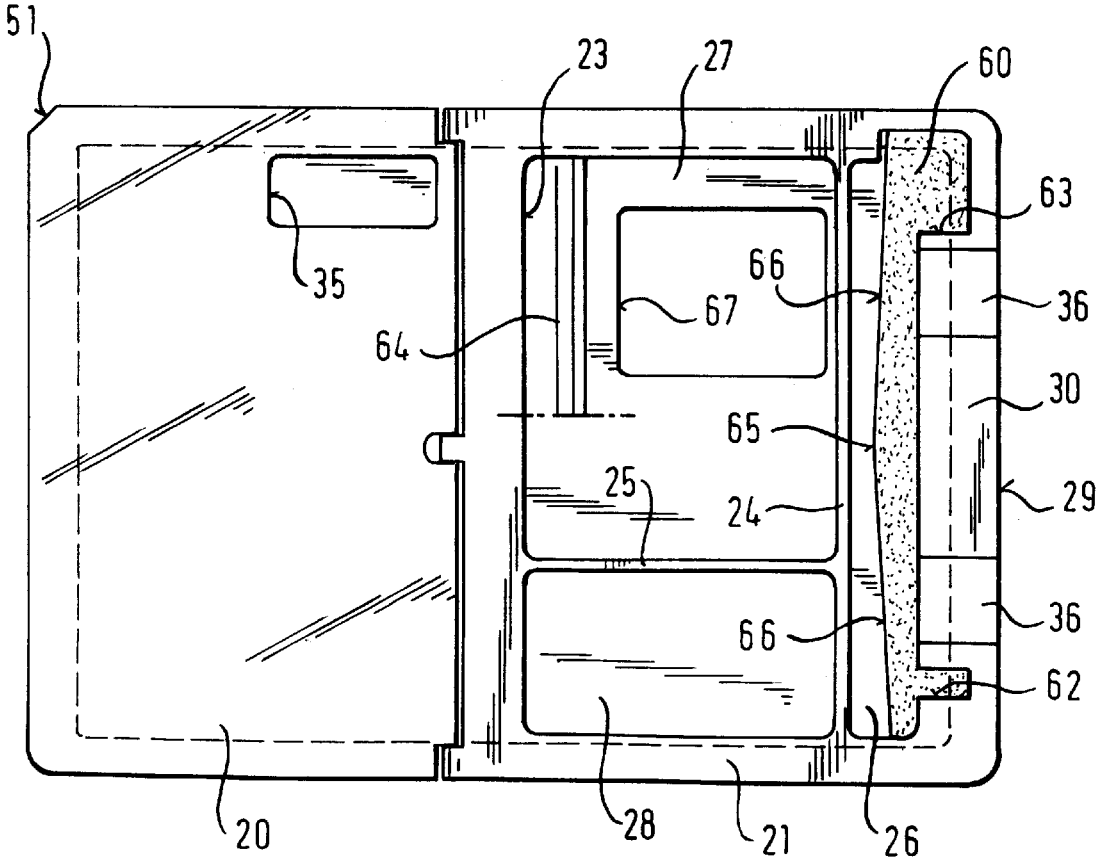

As is illustrated in the top half in FIG. 9, and in FIG. 8, a convexly arched strip 64 may be arranged on the bottom bearing surface 17, and this strip forms an oblique flank 16' assigned to the top bearing surface 18. In this case, the strip 64 is arranged in the vicinity of the pivot axis, and parallel to the latter, with the result that the flank 16' is located in the same region as flank 16' of the step 16 in the cassette according to FIGS. 1 and 2.

Depending on the material used for the passports, and depending on which side of the sheet which is to have text printed on it is to receive said text, it is possible for the distance of the strip 64 from the pivot axis to be selected to be larger or smaller or, as is illustrated in the bottom half in FIG. 9, for the strip 64 to be omitted completely.

The operation of introducing a passport into the cassette 10 described with reference to FIGS. 8 and 9 takes place in such a manner that first of all the passport is swung open such that the sheet which is to have text printed on it lies open with the side which is to have text printed on it lying uppermost. The passport is then pushed into the receiving region between the bottom bearing surface 17 and the frame plate 20. Thereafter, that part of the passport which is located beneath the sheet which is to have text printed on it is pushed, by way of its free edge, into the receiving pocket 61, between the top and bottom bearing surfaces 18 and 17, respectively. When the swing-action frame 21 is closed, it is then only the sheet which is to have text printed on it which is forced down, by way of its free edge, onto the top bearing surface 18. By virtue of the inherent stressing in the region of the binding, and if appropriate by virtue of the support by means of the convexly arched strip 64, the sheet which is to have text printed on it is prestressed such that it is forced into a defined plane by the holding-down webs 24, 25 and the swing-action frame itself.

It is possible in this case for the position in the cassette 10 of the sheet which is to have text printed on it to vary from passport to passport, but also, in part, during transportation, but said position remains unchanged at least as long as the cassette is not moving.

As a result, it is possible for the position of the border of the sheet which is to have text printed on it to be detected through the monitoring windows 62, 63 when the cassette, with the passport located therein, is arranged in the text-printing station of a text-printing apparatus.

In order to make it easier for the passport to be introduced into the cassette and to make it easier, in particular, for the passport section which is located beneath the sheet which is to have text printed on it to be introduced into the receiving pocket 61, the strip-like plate 60 has two bevels 66 forming a point 65, with the result that that part of the passport which is to be pushed into the receiving pocket 61 need only be pushed under the point 65 of the plate 60 in order then to be guided by the bevels 66 during the pushing-in operation.

In order to facilitate removal of the passport, an opening 67 is provided in the base plate 11 in the region of the swing-action frame 21, it being possible for a passport which has been introduced in the cassette to be forced out through said opening once the swing-action frame 21 has been opened.

In order for the passport to have text printed on it by the process according to the invention, the operations of introducing the passport into the cassette and of feeding the cassette to the text-printing station in the text-printing apparatus are followed by the position of the free edge of the sheet which is to have text printed on it being detected in the region of one corner through the monitoring window 62. The position of the free edge is then established in the region of the other corner through the monitoring window 63, this determining alignment of the free edge. In order to detect entirely the position of the border of the sheet which is to have text printed on it, the position of a side edge is then established through the monitoring window 63. In this case, use is expediently made of that side edge of the sheet which is to have text printed on it from which the position of the machine-readable passport identification is measured.

In order to make it easier to establish the edge position, the top side of the plate 60, that is to say the bearing surface 18, is of contrasting colour. This can be achieved, for example, by a dark-coloured or black coating or covering. It is also possible, however, just to use a colour-contrast material for the plate 60.

Otherwise, the operations for determining the pattern on the sheet which is to have text printed on it, and of printing the text, take place in the same way as has been described above.

What is claimed is:

1. Process for printing text on a sheet of a booklet-like article in a text-printing station, in the case of which the booklet-like article is arranged in a swung-open state in a cassette (10) and fed to the text-printing station, the position in the text-printing station of the border of the sheet which is to have text printed on it is detected, as is the position of a pattern provided on the sheet which is to have text printed on it, and the sheet has text printed on it such that some of the text is aligned with respect to the pattern and other parts of the text are aligned with respect to the sheet border.

2. Process according to claim 1, characterized in that that sheet of the booklet-like article which is to have text printed on it is arranged in the cassette (10) such that the position of the sheet border itself can be detected.

3. Process according to claim 2, characterized in that the position of the sheet border is detected at three points, the position of one edge of the sheet border being detected at two points and the position of a further edge, which is located transversely with respect to the first-mentioned edge, being detected at one point.

4. Process according to claim 1, characterized in that that sheet of the booklet-like article which is to have text printed on it is guided, in the cassette (10), by stop and retaining means (37) into a position which is predetermined relative to the cassette (10), and in that the position of the cassette (10) is detected in order to determine the position of the sheet border therefrom.

5. Process according to claim 1, characterized in that some of the text is aligned both with respect to the predetermined pattern and with respect to the sheet border.

6. A cassette (10) for receiving and handling a booklet-like article made of sheet-like material, comprising:

(a) a base plate (11) including a bearing region (15) having a first bearing surface (17); and (b) frame means (12) movably connected with said base plate opposite at least a part of said bearing region;

(c) said bearing region including a second bearing surface (18) parallel with and offset from said first bearing surface in a direction toward said frame means and normal to said first bearing surface.

7. A cassette as define in claim 6, wherein said frame means (12) includes a frame plate (20) mounted on said base plate (11), and a frame member (21) pivotally connected with said frame plate, said frame member containing a window (23).

8. A cassette as defined in claim 7, wherein said frame member is pivotally displaceable between open and closed positions relative to said base plate, said frame member in said closed position extending over said second bearing surface, said frame member including hold-down web means (24, 25) arranged in said window for retaining a planar sheet on said bearing region, thereby to permit text to be printed on said sheet.

9. A cassette as defined in claim 7, and further including snap-action connecting means (36) for retaining said frame member in said closed position.

10. A cassette as defined in claim 6, wherein when said frame member is in said open position, said frame member subtends an angle relative to said base plate from about 110° to about 150°.

11. A cassette as defined in claim 6, and further including a step (16) having a beveled flank (16') is provided between said first and second bearing surfaces (17 and 18).

12. A cassette as defined in claim 11, wherein said beveled flank (16') is angularly arranged relative to said second bearing surface (18) at an angle ($\alpha$) of from about 205° to about 225°.

13. A cassette as defined in claim 11, wherein said beveled flank (16') merges in a rounded surface (16") with said second bearing surface.

14. A cassette as defined in claim 6, and further wherein said frame member (21) includes on the side thereof adjacent said base plate stop and retaining means (37) for positioning a sheet-like article in an aligned position relative to said frame (12).

15. A cassette as defined in claim 14, wherein said stop and retaining means comprises means (39) defining a pocket (41) for retaining the sheet-like relative to said frame member during the pivotal movement of said frame member relative to said base plate.

16. A cassette as defined in claim 6, and further wherein said base plate includes an additional plate portion (60) that extends partially over a portion of one side of said first bearing surface, said plate portion carrying said second bearing surface in a strip-like manner, thereby to permit the sheet of a booklet-like article to be positioned on said second bearing surface for printing of test material on the sheet.

17. A cassette as defined in claim 16, wherein said plate portion is spaced from said first bearing portion and cooperates therewith to define a pocket (61).

18. A cassette as defined in claim 16, wherein said additional plate portion has in plan view a generally convex configuration (65, 66).

19. A cassette as defined in claim 16, wherein the peripheral portion of frame member (210) contains adjacent a comer of said frame member at least one monitoring window (62, 63) opposite said additional plate portion.

20. A cassette as defined in claim 19, wherein said second bearing surface has a different color than said frame member.

21. A cassette as defined in claim 16, and further including a convex arched strip (64) secured to said first bearing surface, said convex arched strip being parallel with and spaced laterally from said second bearing surface.

* * * * *